US009835405B2

(12) United States Patent
Maeda

(10) Patent No.: US 9,835,405 B2
(45) Date of Patent: Dec. 5, 2017

(54) TOY GUN

(71) Applicant: Maruzen Company Limited, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 15/054,348

(22) Filed: Feb. 26, 2016

(65) Prior Publication Data

US 2016/0258712 A1 Sep. 8, 2016

(30) Foreign Application Priority Data

Mar. 3, 2015 (JP) ..... 2015-041073

(51) Int. Cl.

| | |
|---|---|
| ***F41B 11/89*** | (2013.01) |
| ***F41A 9/24*** | (2006.01) |
| ***F41A 9/76*** | (2006.01) |
| ***F41B 11/55*** | (2013.01) |
| *F41B 11/73* | (2013.01) |

(52) U.S. Cl.

CPC ..... *F41B 11/89* (2013.01); *F41A 9/24* (2013.01); *F41A 9/76* (2013.01); *F41B 11/55* (2013.01); *F41B 11/73* (2013.01)

(58) Field of Classification Search

CPC F41B 11/89; F41B 11/55; F41B 11/73; F41A 9/24; F41A 9/76

USPC ..... 124/64

See application file for complete search history.

(56) References Cited

U.S. PATENT DOCUMENTS

| | | | | |
|---|---|---|---|---|
| 1,049,106 A | | 12/1912 | Key | |
| 2,086,339 A | * | 7/1937 | Sosso | F41A 9/65 42/49.01 |
| 5,285,766 A | | 2/1994 | Milliman | |
| 5,295,320 A | * | 3/1994 | Svensson | F41A 9/76 42/49.01 |
| 5,660,159 A | * | 8/1997 | Clayton | F41B 11/54 124/59 |

(Continued)

FOREIGN PATENT DOCUMENTS

| | | |
|---|---|---|
| DE | 195 42 332 C1 | 5/1997 |
| TW | I356155 B | 1/2012 |

OTHER PUBLICATIONS

Search Report issued in European Application No. 16000141.8, dated Jun. 29, 2016.

(Continued)

*Primary Examiner* — Joshua Freeman

(74) *Attorney, Agent, or Firm* — Michael Best & Friedrich LLP

(57) ABSTRACT

The moving distance of a cartridge which is actuated each time a trigger is pulled once can be increased. A toy gun includes: a trigger; a cartridge in which cartridge bullet loading portions loaded with bullets are continuously provided and which is installed ahead of the trigger; a link mechanism (including a trigger rear end portion, a link A, a link B, a rod, and an arm) which is once extended from behind the trigger to the side opposite the cartridge installation position and thereafter inverted and whose tip is extended to ahead of the trigger; and a nail which is actuated through the link mechanism in conjunction with the actuation of the trigger and moves the cartridge.

8 Claims, 14 Drawing Sheets

(56) References Cited

U.S. PATENT DOCUMENTS 5,680,853 A * 10/1997 Clayton ..... F41B 11/54 124/59
5,906,191 A 5/1999 Wonisch et al.
6,494,194 B2 * 12/2002 Shipachev ..... F41A 9/76 124/31
6,530,368 B1 * 3/2003 Maeda ..... F41B 11/55 124/48
6,796,300 B2 * 9/2004 Petrosyan ..... F41B 11/55 124/48
7,669,588 B2 3/2010 Maeda
7,765,997 B2 * 8/2010 Klockener ..... F41A 9/76 124/48
7,963,280 B2 * 6/2011 Maeda ..... F41A 9/73 124/45
8,839,771 B2 * 9/2014 Tseng ..... F41A 9/67 124/40
9,335,116 B1 * 5/2016 Wei ..... F41A 9/68
9,389,042 B1 * 7/2016 Clayton ..... F41B 11/642
2003/0075160 A1 * 4/2003 Petrosyan ..... F41B 11/55 124/45
2003/0127085 A1 * 7/2003 Brunette ..... F41B 11/55 124/74
2008/0155875 A1 * 7/2008 Iwasawa ..... F41B 11/89 42/54
2009/0139507 A1 6/2009 Maeda
2009/0151710 A1 * 6/2009 Zimmerman ..... F42B 39/087 124/48
2010/0154765 A1 * 6/2010 Klockener ..... F41A 9/76 124/51.1
2011/0253119 A1 * 10/2011 Cho ..... F41B 11/54 124/41.1

OTHER PUBLICATIONS

Search Report issued in Taiwan Patent Application No. 105101734, dated Jan. 9, 2017.

* cited by examiner

TOY GUN

CROSS-REFERENCE TO RELATED APPLICATION(S)

This application is based upon and claims the benefit of priority from Japanese Patent Application JP2015-041073, filed on Mar. 3, 2015, the entire disclosure of which is incorporated herein by reference.

TECHNICAL FIELD

The present invention relates to toy guns and in particular to rotating mechanisms of cartridges for toy guns. In more particular, the present invention relates to a rotating mechanism of a cartridge for a toy gun which mechanism rotates the cartridge in conjunction with firing of a bullet in a toy gun with the cartridge loaded with bullets, such as BB bullets, attached to the gun.

BACKGROUND ART

As a charging mechanism of a toy gun which charges bullets, such as BB bullets, to the toy gun, for example, what is shown in the drawings in Patent Document 1 protected by the patent owned by the present applicant, is known (Patent Document 1, U.S. Pat. No. 7,669,588). FIG. 13 in Patent Document 1 shows a nail 4 and a cylindrical rotary clip C loaded with six bullets. According to Patent Document 1, the rotary clip C is rotated by approximately 2 mm equivalent to one bullet, by the nail 4 directly coupled with an arm 1 each time a trigger 8 is pulled once. The arm 1 is provided in proximity to the trigger 8 between the trigger 8 and the rotary clip C.

[Patent Document 1] U.S. Pat. No. 7,669,588

SUMMARY OF THE INVENTION

Technical Problem

The invention described in Patent Document 1 (U.S. Pat. No. 7,669,588) is suitable for rotating the rotary clip C by approximately 2 mm equivalent to one bullet by the nail 4 each time the trigger 8 is pulled once. The nail 4 is actuated by the arm 1 provided in proximity to the trigger 8 between the trigger 8 and the rotary clip C and this reduces the movable distance. When the moving distance of the cartridge in a magazine is greater than 2 mm, for example, 8 mm, it is difficult to cause actuation equivalent to one bullet.

It is an object of the present invention to increase the moving distance of a cartridge which is actuated each time a trigger is pulled once. It is another object of the present invention to prevent compressed gas as an energy source from leaking out from a gap, to enhance energy efficiency.

Solution to Problem

A toy gun of the present invention comprises:

a trigger;

a cartridge in which cartridge bullet loading portions capable of being loaded with bullets are continuously provided and which is installed ahead of or behind the trigger;

a link mechanism which is extended from the trigger to the side opposite the cartridge installation position and thereafter inverted and whose tip is extended to the cartridge; and a nail which is actuated through the link mechanism in conjunction with the actuation of the trigger and moves the cartridge.

A toy gun of the present invention comprises:

a trigger;

a cartridge in which cartridge bullet loading portions capable of being loaded with bullets are continuously provided and which is installed ahead of the trigger;

a link mechanism which is extended from behind the trigger to the side opposite the cartridge installation position and thereafter inverted and whose tip is extended to ahead of the trigger; and a nail which is actuated through the link mechanism in conjunction with the actuation of the trigger and moves the cartridge.

Possibly, the toy gun of the present invention further comprises:

a gas discharging means which moves toward the cartridge in conjunction with the actuation of the trigger and discharges gas to a cartridge bullet loading portion; and a cylindrical cover provided between the gas discharging means and each cartridge bullet loading portion.

Effect of the Invention

According to the present invention, it is possible to increase the moving distance of a cartridge which is actuated each time a trigger is pulled once. According to one embodiment of the present invention, further, it is possible to prevent compressed gas as an energy source from leaking out from a gap, to enhance energy efficiency.

DETAILED DESCRIPTION OF THE PREFERRED EMBODIMENTS

A description will be given to an embodiment of the present invention with reference to the drawings illustrating the embodiment of the present embodiment.

Figure 1:
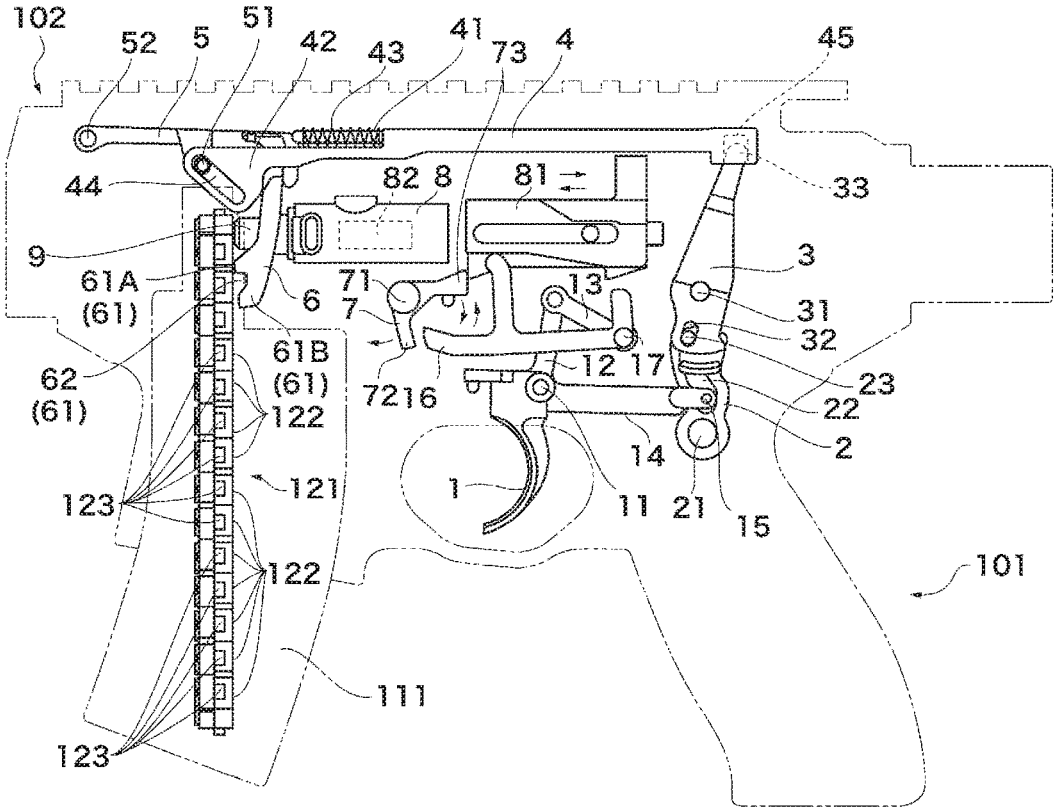
FIG. 1 is a front sectional view showing an initial state, in a toy gun in an embodiment of the present invention.

In FIG. 1 and the following drawings, reference numeral 101 denotes a toy gun body; 102 denotes a muzzle; 111 denotes a magazine body; and 1 denotes a trigger attached to the toy gun body 101.

Figure 13:
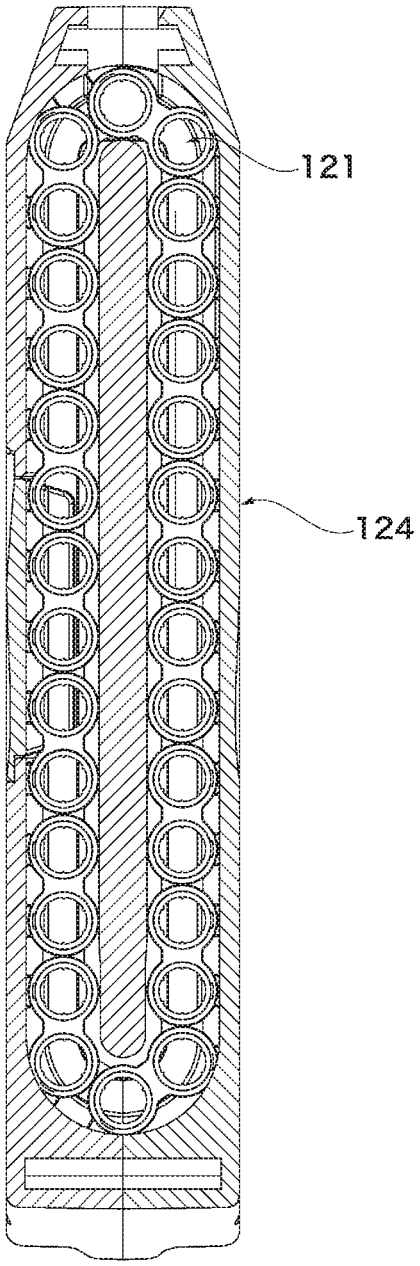
FIG. 13 is a sectional view of the front center of a magazine body loaded with a cartridge, in a toy gun in an embodiment of the present invention.

The magazine body 111 is inserted on the forward side of the trigger 1 of the toy gun body 101, located on the left side of the drawing, that is, on the muzzle 102 side. Reference numeral 121 denotes a cartridge. As shown in FIG. 13, the cartridge 121 is housed in the magazine body 111.

The cartridge 121 is mounted ahead of or behind the trigger 1 depending on the type of the toy gun. In this embodiment, the cartridge 121 is provided ahead of the trigger 1.

Figure 11:
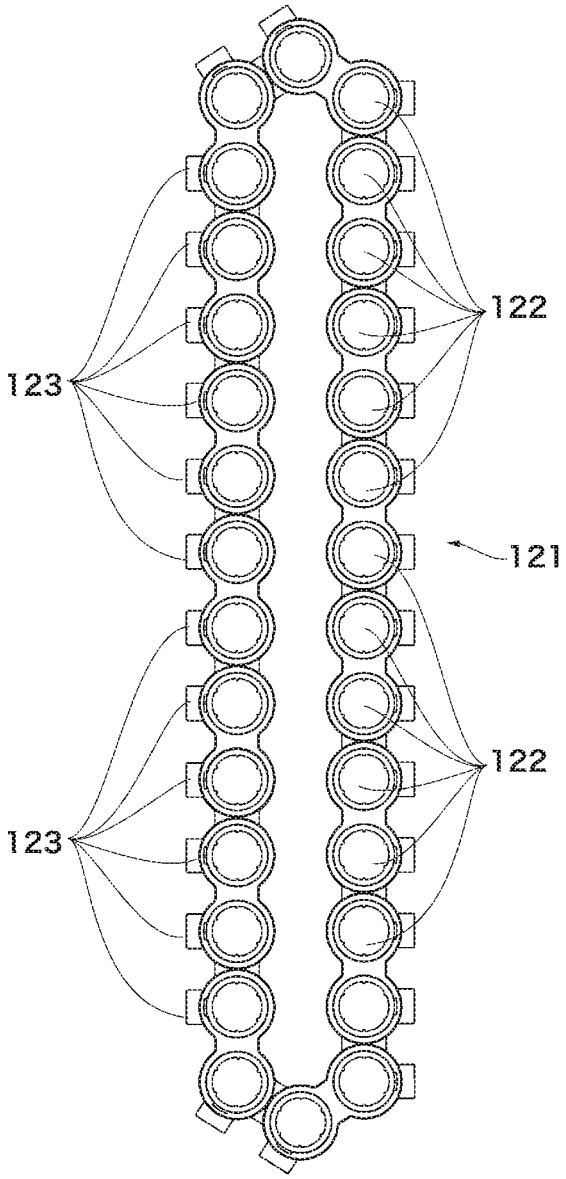
FIG. 11 is a front view of a cartridge, in a toy gun in an embodiment of the present invention.
Figure 12:
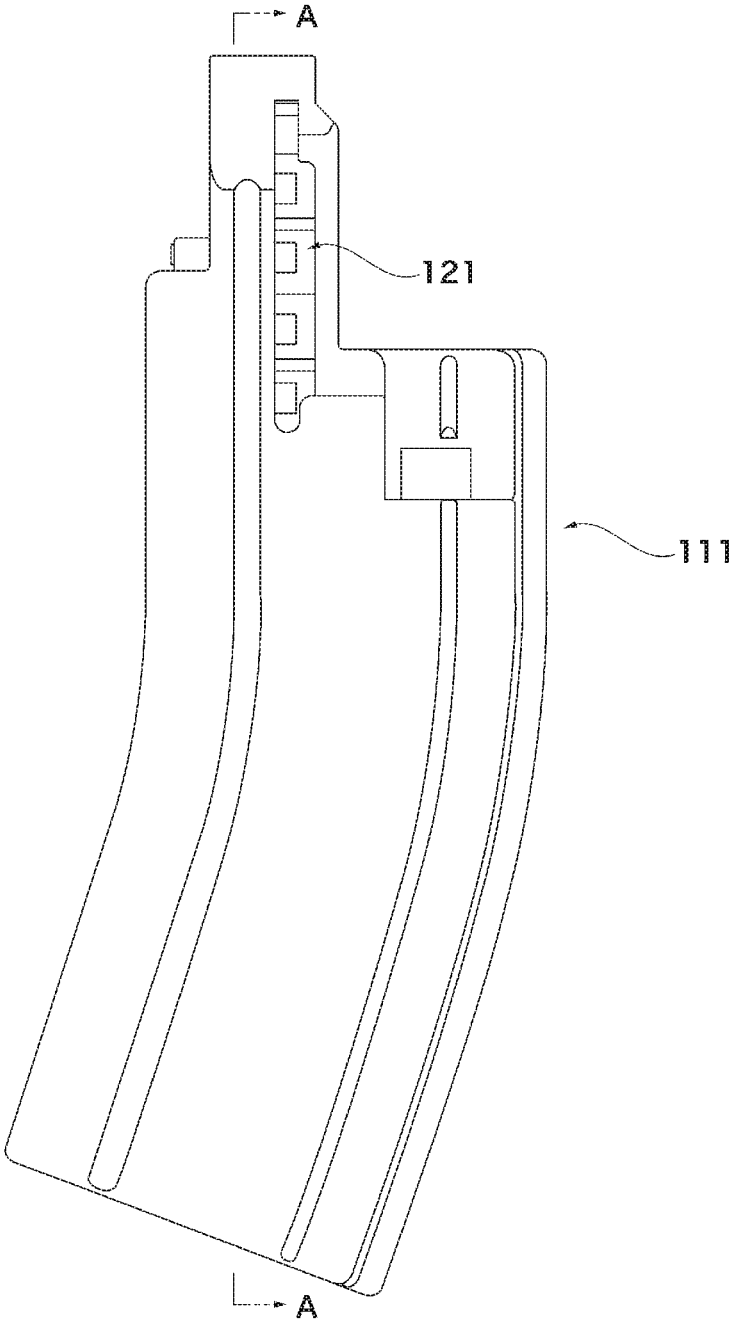
FIG. 12 is a front view of a magazine body loaded with a cartridge, in a toy gun in an embodiment of the present invention.

The cartridge 121 is formed by continuously coupling a plurality of cylindrical bullet loading portions 122 in an identical shape. There are two types of the cartridge 121, endless type in which the beginning and end of a cartridge are coupled with each other and continuous type in which the beginning and the end are not coupled with each other. A bullet is loaded into each bullet loading portion 122. With the cartridge 121 housed in and the magazine body 111 loaded into the toy gun body 101, the cartridge 121, as shown in FIG. 11 and FIG. 13 as viewed from the muzzle 102 side, forms an endless annular shape or a continuous shape in which the beginning and end of the cartridge are not coupled with each other. In each bullet loading portion 122, a cartridge protrusion 123 protruded on the side of a side face of the toy gun 101 body is provided on the side face of the loading portion.

The trigger 1 is energized clockwise in the drawing by a trigger spring (not shown). The trigger 1 can be rotated counterclockwise in the drawing about a trigger pivot 11.

Reference numeral 14 denotes a trigger rear end portion and 12 denotes a trigger upper protrusion. The trigger rear end portion 14 is protruded at the rear portion of the trigger 1. The trigger 1 is coupled with a link A 2 at the trigger rear end portion 14. The trigger 1 is coupled with a trigger bar link 13 coupled with the trigger upper protrusion 12 provided above the trigger 1. Reference numeral 15 denotes a trigger protrusion. The trigger protrusion 15 is provided at the rear end of the trigger rear end portion 14 and is protruded toward the link A 2 located on the far side of the drawing.

Reference numeral 16 denotes a trigger bar. The trigger bar 16 is in an inverted T shape as a whole. Reference numeral 17 denotes a trigger bar pivot. The trigger bar pivot 17 is a coupling pivot which couples the trigger bar 16 and the trigger bar link 13 with each other. The trigger bar 16 is coupled at the rear end with the trigger bar link 13 by the trigger bar pivot 17 and can be rotated about the trigger bar pivot 17.

Reference numeral 2 denotes the link A. The link A 2 can be rotated about a link A pivot 21. The link A 2 is energized forward, that is, leftward in FIG. 1, by the trigger spring. The central part of the link A 2 is provided with a guide 22, which is comprised of an opening which is substantially of an ellipse shape and inclined slightly forward as it goes upward. The trigger protrusion 15 provided at the rear end of the trigger rear end portion 14 is fit into the guide 22, and the link A 2 and the trigger rear end portion 14 are coupled with each other.

Reference numeral 23 denotes a link A protrusion. The link A protrusion 23 is arranged at the upper end portion of the link A 2 so as to protrude toward a link B, on the far side of the drawing.

Reference numeral 3 denotes the link B. The link B 3 can be rotated about a link B pivot 31.

Reference numeral 32 denotes an opening. The opening 32 is provided in the lower part of the link B 3. The link A protrusion 23 provided in the link A 2 is fit into the opening 32 and the link A 2 and the link B 3 are coupled with each other.

Reference numeral 33 denotes an upper end portion provided at the upper end of the link B 3.

Reference numeral 4 denotes a rod. The rod 4 is in a stick shape as a whole and the tip of the rod 4 is bifurcated into an upper rod end A 41 and a lower rod end B 42. The rod end A 41 is short and provided in parallel to the upper part of the rod end B 42 and has a rod spring 43 attached around the rod end A 41. The rod spring 43 energizes the entire rod 4 backward in the drawing. When the trigger 1 is pulled and returned, the rod spring 43 acts to return the link B 3 including the rod 4 and an arm 5 to their original positions. When the trigger spring strongly acts, the rod spring 43 is not necessarily required.

The rod end B 42 is extended beyond the rod end A 41, and at the end of the rod end B 42, an obliquely arranged ellipse guide 44 which is brought upward as it goes toward the muzzle 102, that is, forward.

Reference numeral 45 denotes a coupling hole. The coupling hole 45 is provided at the rear end of the rod 4 so as to be opened downward. An upper end portion 33 provided in the link B 3 is inserted into the coupling hole 45 and the link B 3 and the rod 4 are coupled with each other.

Reference numeral 5 denotes the arm. The arm 5 is attached ahead of the rod 4. Reference numeral 51 denotes an arm pivot. The arm 5 can be moved in conjunction with the movement of the arm pivot 51. The arm pivot 51 is inserted into the guide 44 provided in the rod end B 42 and the rod 4 and the arm 5 are coupled with each other. Reference numeral 52 denotes and arm attachment pivot. The arm attachment pivot 52 attaches the front end of the arm 5 to the toy gun body 101 so that the arm 5 can be rotated about the arm attachment pivot 52.

For this reason, when the rod 4 is moved toward the muzzle, that is, forward, the arm pivot 51 is guided by the guide 44 and moved downward and the arm 5 is rotated about the arm attachment pivot 52. Consequently, the rear end of the arm 5 is moved downward. Conversely, when the rod 4 is moved backward by the energizing force of the trigger spring or the rod spring 43, the arm pivot 51 is guided by the guide 44 and is moved upward.

Reference numeral 6 denotes a nail. The nail 6 is provided substantially in the vertical direction and is provided, in its lower part, with a cartridge abutment portion 61 abutted against a cartridge protrusion 123 of the cartridge 121. The cartridge abutment portion 61 is composed of two abutment portions, upper cartridge abutment portion 61A and lower cartridge abutment portion 61B, and a fitting portion 62. The fitting portion 62 is a recess formed between the cartridge abutment portion 61A and the cartridge abutment portion 61B. The width of the fitting portion 62 is matched with the width of each cartridge protrusion 123 in the vertical direction.

Figure 6:
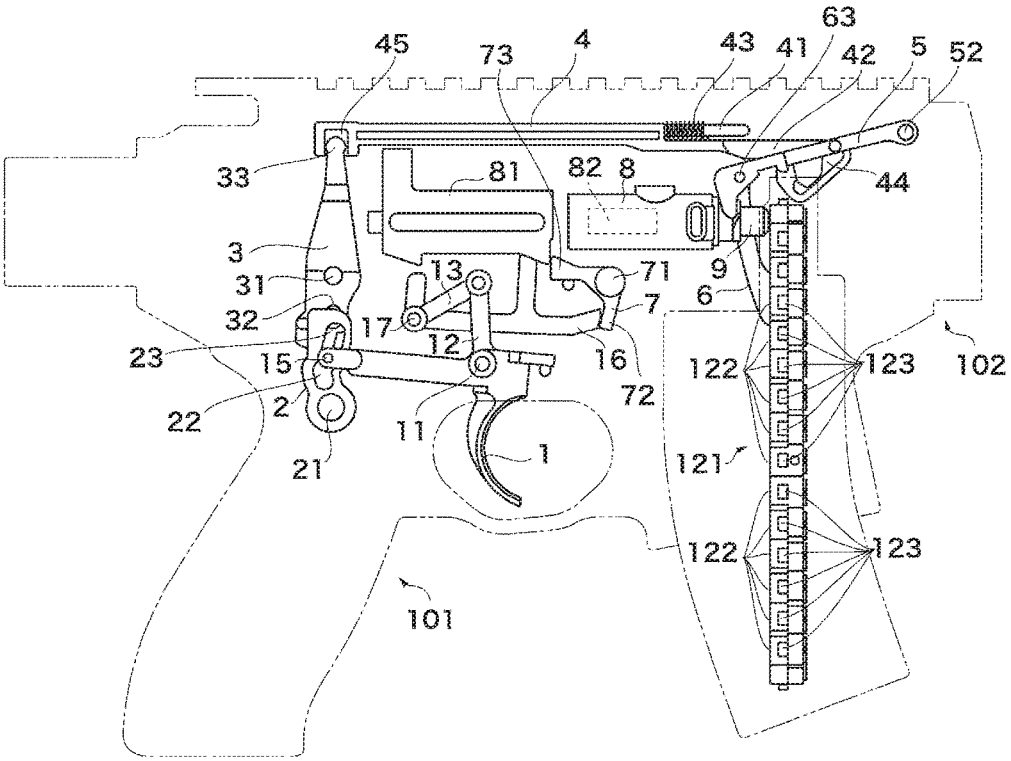
FIG. 6 is a rear sectional view showing a state of moment at which a cover is started to move, in a toy gun in an embodiment of the present invention.
Figure 7:
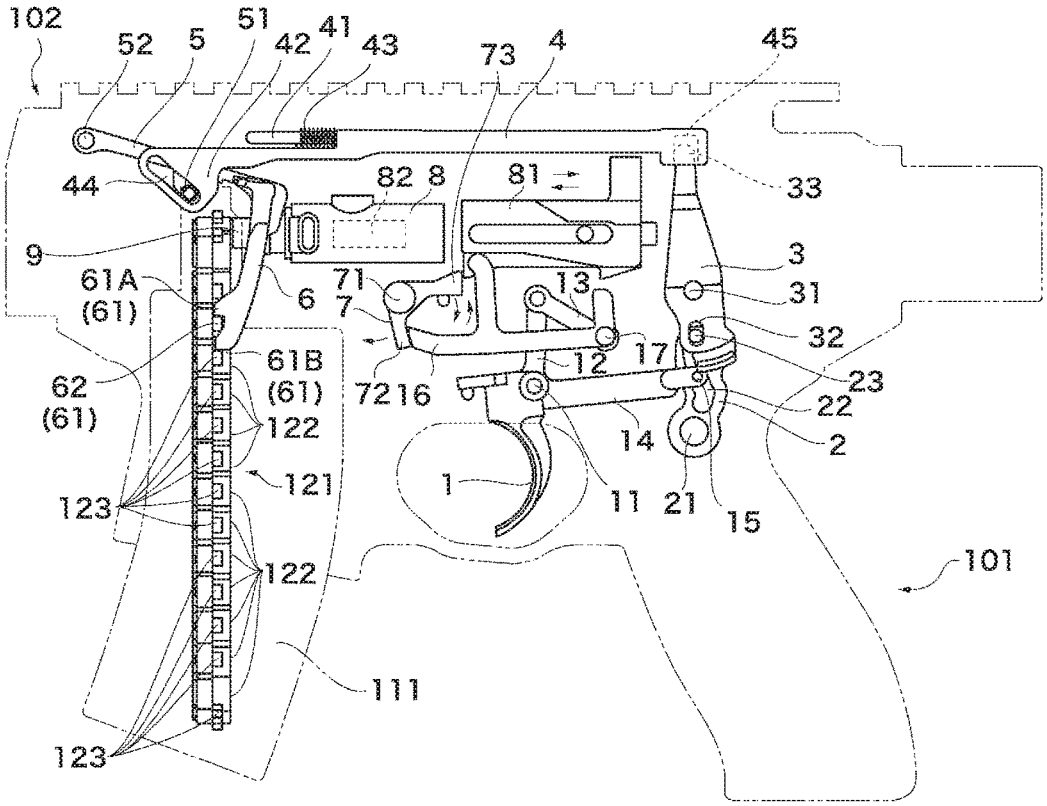
FIG. 7 is a front sectional view showing a state that a cartridge and a cover have completed moving, in a toy gun in an embodiment of the present invention.
Figure 8:
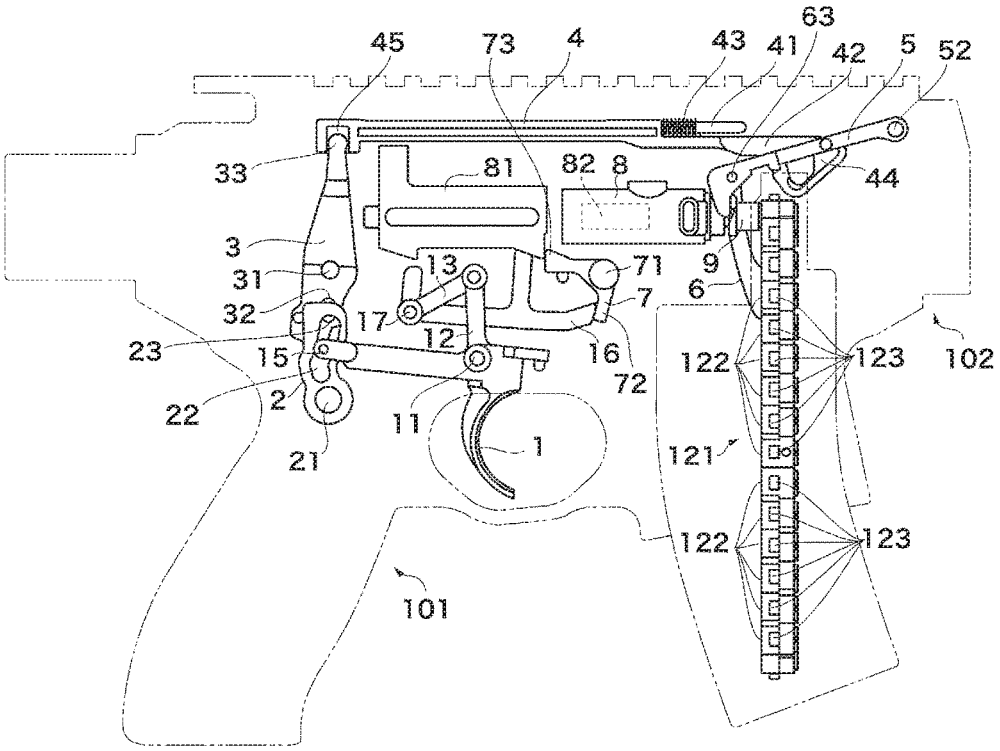
FIG. 8 is a rear sectional view showing a state that a cartridge and a cover have completed moving, in a toy gun in an embodiment of the present invention.

As shown in FIG. 6 and FIG. 8, meanwhile, the nail 6 and the arm 5 are coupled with each other by a nail rotating pivot 63 provided in the upper end portion of the nail 6 at the rear end portion of the arm 5.

For this reason, each cartridge protrusion 123 of the cartridge 121 and the upper cartridge abutment portion 61A and lower cartridge abutment portion 61B of the nail 6 are abutted against each other. With the cartridge protrusion 123 fit by the fitting portion 62, the cartridge 121 is moved down as the nail 6 is moved down.

Reference numeral 7 denotes a sear. The sear 7 is attached ahead of the trigger bar 16 so that the sear 7 can be rotated about a sear pivot 71. The sear 7 is energized counterclockwise in the drawing, that is, to the direction shown by an arrow in the drawing by a sear spring (not shown). Two free ends, trigger bar end portion 72 and bolt end portion 73, are protruded from the sear 7. The trigger bar end portion 72 is protruded on the trigger bar 16 side and in contact with the trigger bar 16; and the bolt end portion 73 is protruded on the bolt 81 side and in contact with a bolt 81.

Reference numeral 8 denotes a valve body. The valve body 8 is provided ahead of the bolt 81. A discharge valve 82 is installed in the valve body.

Figure 14:
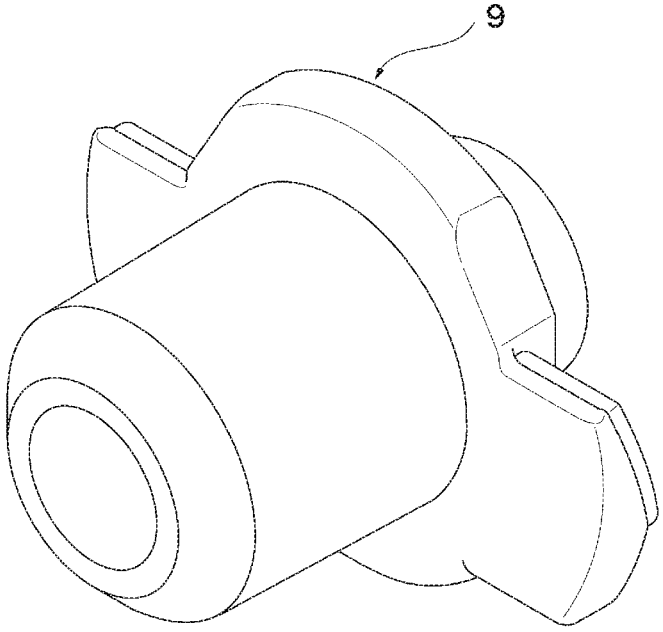
FIG. 14 is a front perspective view of a cover, in a toy gun in an embodiment of the present invention.
Figure 15:
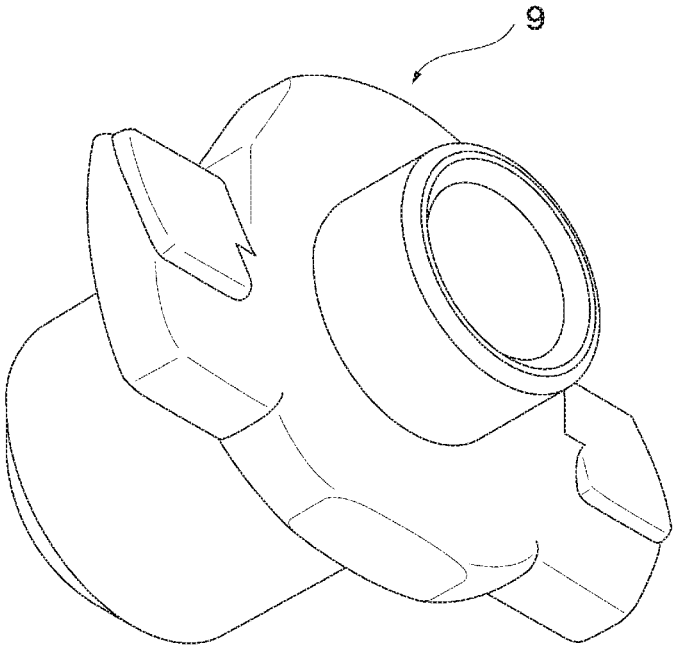
FIG. 15 is a rear perspective view of a cover, in a toy gun in an embodiment of the present invention.

Reference numeral 9 denotes a cover. As illustrated in FIG. 14 and FIG. 15, the cover 9 is substantially in a cylindrical shape corresponding to the diameter of each cartridge bullet loading portion 122 and has a cavity in its inside. The cover 9 is provided at the front end portion on the cartridge 121 side, of the valve body 8. In the initial state, the cover 9 or the arm 5 is not fit together. The rear end portion of the arm 5 can be abutted against the cover 9.

The bolt 81 is pressed forward by a bolt spring (not shown). Pressed by the bolt 81, the discharge valve 82 as a gas discharging means provided in the valve body 8 moves forward. As the result of the forward movement of the discharge valve 82, compressed gas filled in the valve body 8 flows out. The gas goes through the cavity in the cover 9 and pushes forward a bullet loaded in a cartridge bullet loading portion 122. As a result, the bullet is fired.

The trigger rear end portion 14, link A 2, link B 3, rod 4, arm 5, and the like located between the trigger 1 and the nail 6 constitute a link mechanism. The link mechanism is extended from behind the trigger 1. The link mechanism is extended from the trigger to the side opposite the cartridge installation position and then inverted and the tip of the mechanism is extended to the cartridge 121 ahead of the trigger 1.

The cartridge 121 may be installed ahead of or behind the trigger 1 depending on the type of the toy gun. In this embodiment, the cartridge 121 is provided ahead of the trigger 1. When the cartridge 121 is installed behind the trigger 1, the link composed of the trigger rear end portion 14, link A 2, link B 3, rod 4, arm 5, and the like located between the trigger 1 and the nail 6 is extended in the opposite direction and installed.

A description will be given to the action of the embodiment.

Figure 2:
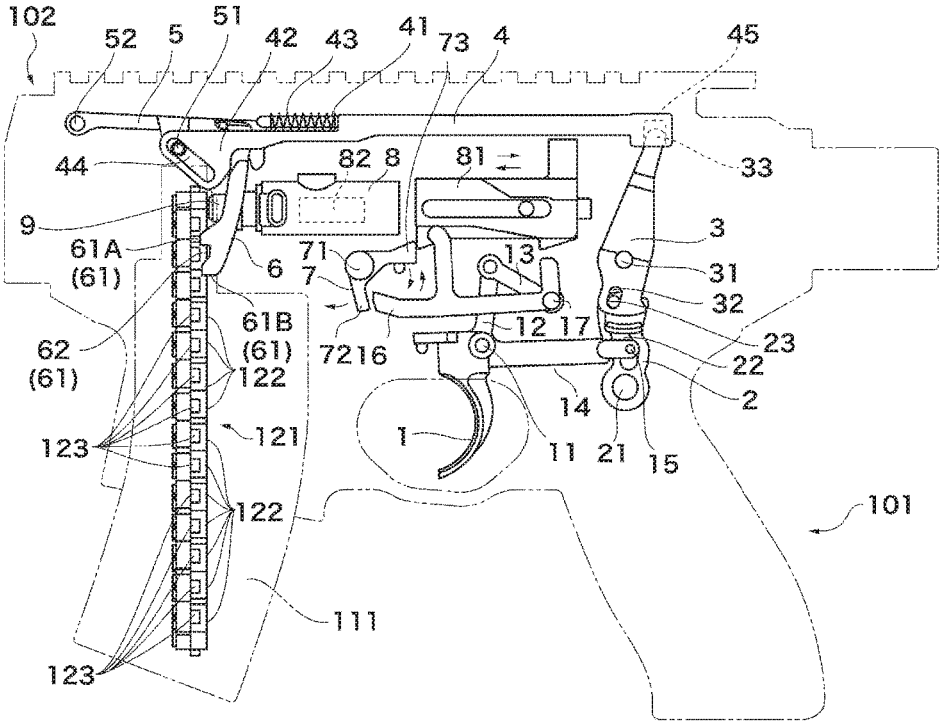
FIG. 2 is a front sectional view showing a state that a nail starts moving, in a toy gun in an embodiment of the present invention.

When the trigger 1 is pulled in the state illustrated in FIG. 1, the trigger 1 is rotated counterclockwise about the trigger pivot 11 as shown in FIG. 2 showing the state that the nail 6 starts moving. As the result of the counterclockwise rotation of the trigger 1, the trigger rear end portion 14 moves upward. As the result of the upward movement of the trigger rear end portion 14, the trigger protrusion 15 moves upward guided by the guide 22 and rotates the link A 2 clockwise about the link A pivot 21.

As the result of the clockwise rotation of the link A 2, the link B 3 is rotated counterclockwise.

As the result of the counterclockwise rotation of the link B 3, the rod 4 moves forward to the left side of the drawing. This is because the upper end portion 33 provided in the link B 3 is fit into the coupling hole 45 provided in the rod 4 and the link B 3 and the rod 4 are coupled with each other.

When the rod 4 moves forward in the drawing, the rod end B 42 located at the front end of the rod 4 also moves forward. The arm pivot 51 is inserted into the elliptic guide 44 provided in the rod end B 42 and the rod 4 and the arm 5 are coupled with each other. For this reason, as the rod 4 moves forward, the arm pivot 51 is guided by the elliptic guide 44 and moved. In conjunction with the movement of the arm pivot 51, the arm 5 is rotated clockwise about the arm attachment pivot 52. Then the nail 6 coupled with the arm 5 starts to move down as illustrated in FIG. 2.

Figure 3:
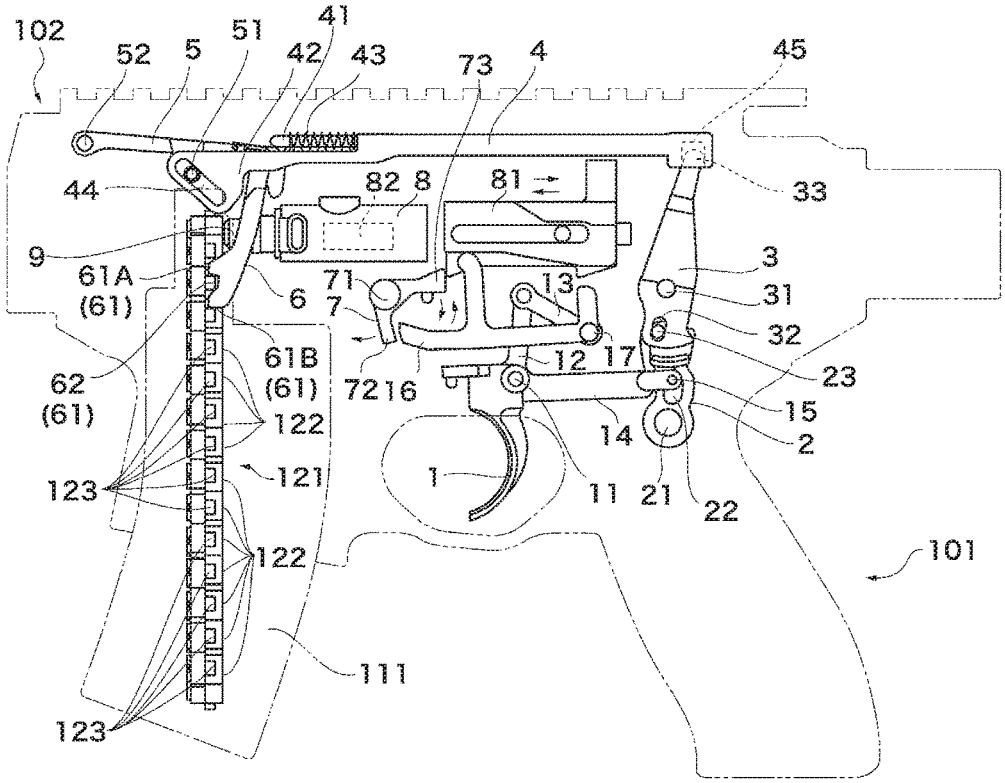
FIG. 3 is a front sectional view showing a state of a moment at which a cartridge is just started to move, in a toy gun in an embodiment of the present invention.

As illustrated in FIG. 3 as a state in which the cartridge 121 is started to move, the nail 6 moves down. The nail 6 is abutted against a cartridge protrusion 123 formed on the side face of a cartridge bullet loading portion 122 composing the cartridge 121 housed in the magazine body 111. Subsequently, the nail 6 moves down and causes the cartridge protrusion 123 to fit into the recessed fitting portion 62 between the upper cartridge abutment portion 61A and the lower cartridge abutment portion 61B.

Figure 4:
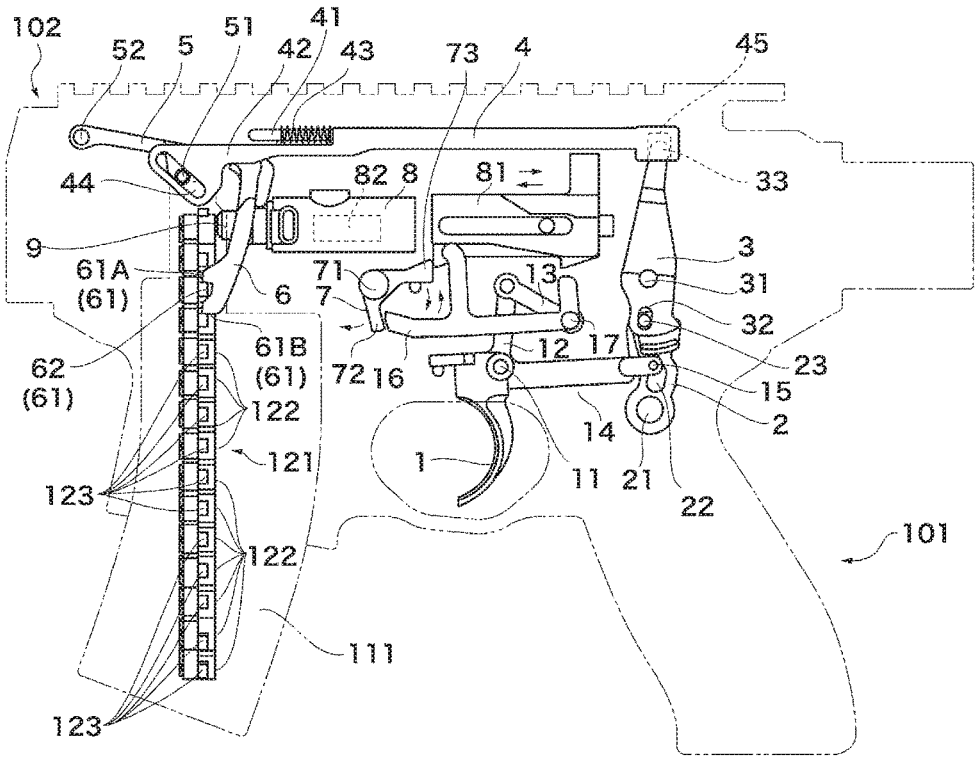
FIG. 4 is a front sectional view showing a state that a cartridge is being moved, in a toy gun in an embodiment of the present invention.
Figure 5:
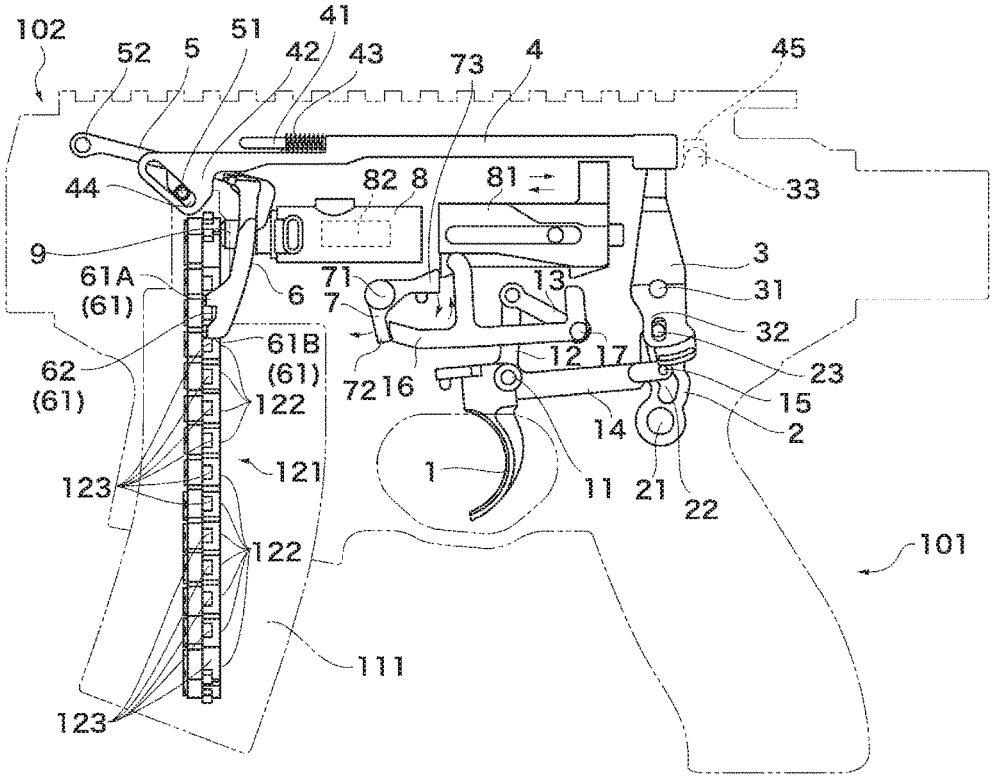
FIG. 5 is a front sectional view showing a state of moment at which a cover is just started to move, in a toy gun in an embodiment of the present invention.

Being kept engaged with the cartridge protrusion 123, the nail 6 moves down. As shown from the state illustrated in FIG. 4 that the cartridge 121 is started to move to the state illustrated in FIG. 5 that the cover 9 is started to move, the nail 6 pushes down the cartridge protrusion 123 of the cartridge 121.

As the result of the nail 6 pushing down the cartridge protrusion 123 of the cartridge 121, the whole of the cartridge 121 which is a group of cartridge bullet loading portions 122 is moved. At the same time, the cover 9 is pressed by the arm 5 and is abutted against a cartridge bullet loading portion 122 of the cartridge 121 housed in the magazine body 111.

Meanwhile, the trigger upper protrusion 12 is moved forward about the trigger pivot 11 by the rotation of the trigger 1. In conjunction with the forward movement of the trigger upper protrusion 12, the trigger link 13 coupled with the trigger upper protrusion 12 is moved forward as sequentially illustrated in FIG. 2, FIG. 3, FIG. 4, and FIG. 5.

The trigger bar 16 is coupled with the trigger link 13 so that the trigger bar 16 can be rotated about the trigger bar pivot 17. Therefore, in conjunction with the forward movement of the trigger link 13, the trigger bar 16 moves forward as sequentially illustrated in FIG. 2, FIG. 3, FIG. 4, and FIG. 5.

Figure 9:
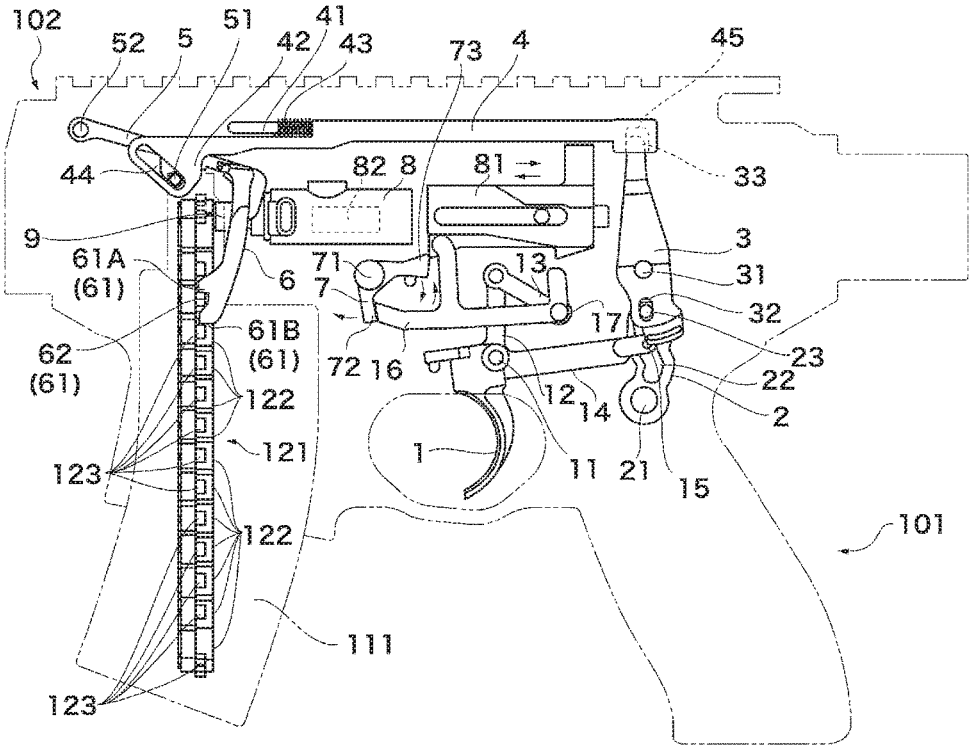
FIG. 9 is a front sectional view showing a state that a sear is being moved, in a toy gun in an embodiment of the present invention.

As the result of the forward movement of the trigger bar 16, the trigger bar 16 is brought into contact with the tip of the sear 7 as illustrated in FIG. 5, FIG. 6, FIG. 7, and FIG. 8. Then the trigger bar 16 pushes the sear 7 forward, that is, toward the muzzle 102 as illustrated in FIG. 9. As a result, the sear 7 is rotated clockwise about the sear pivot 71.

Figure 10:
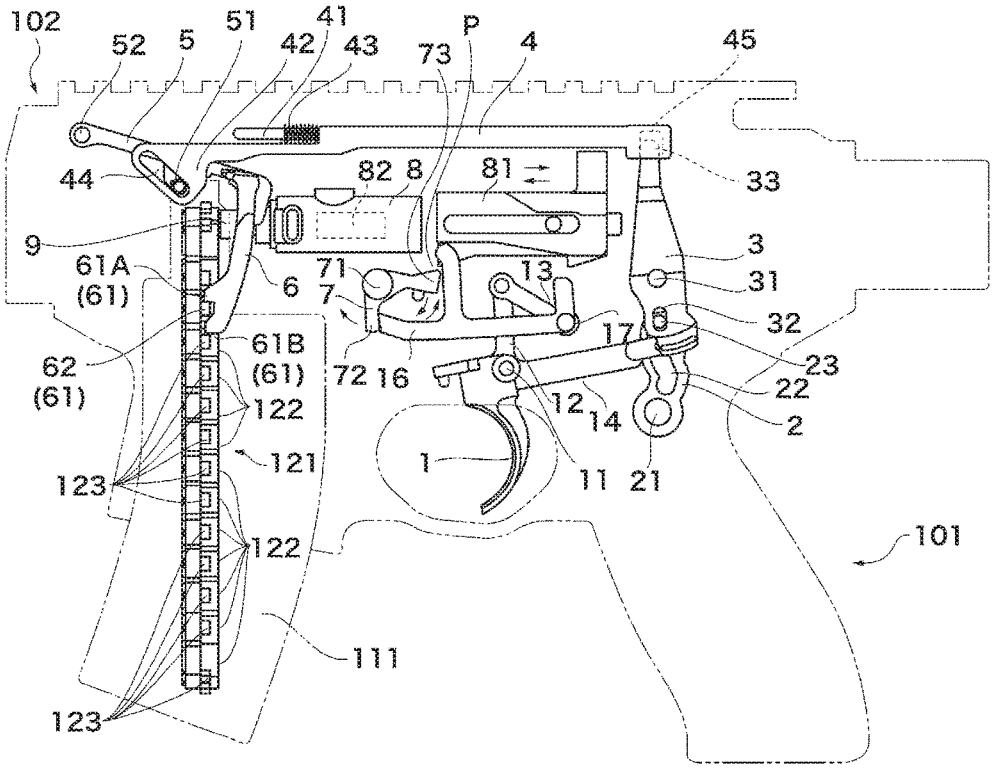
FIG. 10 is a front sectional view showing a state of moment at which the abutment between a sear and a bolt is just released, in a toy gun in an embodiment of the present invention.

As the result of the clockwise rotation of the sear 7, the abutment between the sear 7 and the bolt 81 is removed as indicated by P in FIG. 10. Then the bolt 81 energized forward by the bolt spring starts to move forward. The bolt moves forward and is abutted against the discharge valve 82 provided in the valve body 8 and causes the valve to move forward.

As the result of the forward movement of the discharge valve 82, the valve body 8 is de-hermeticized and high-pressure gas starts to flow out of the valve body. The gas goes through the cavity in the cover 9 provided ahead of the valve body 8 and pushes forward a bullet in a cartridge bullet loading portion 122. As a result, the bullet is fired.

When pulling of the trigger 1 is ceased, the nail 6 is returned to the original position by the action of the trigger spring and the rod spring 43. The nail 6 and the cartridge 121 are brought out of contact and the movement of the cartridge 121 is stopped.

Since the cover 9 is present between the valve body 8 and each cartridge bullet loading portion 122, leakage of compressed gas is prevented and energy efficiency is enhanced.

In this embodiment of the present invention, the movable ranges of main components of the rotating mechanism are maximized; therefore, the distance between the fulcrum and the point of load of each main component is made longer than the distance between the point of effort and the fulcrum. This makes it possible to increase the moving distance of the rotating mechanism as compared with the distance by which the trigger 1 is pulled.

This embodiment of the present invention is further provided with the cover 9. The cover 9 is a member which closes the gap formed between the air chamber (valve body 8) and the cartridge 121 (cartridge bullet loading portions 122) in conjunction with the rotation of the cartridge 121. The cover 9 prevents the formation of a gap between the valve body 8 and the cartridge 121 and is brought into tight contact with the cartridge 121 (cartridge bullet loading portions 122) to prevent the leakage of gas. The leakage of compressed gas as an energy source from a gap is prevented by the cover 9 for the enhancement of energy efficiency.

What is claimed is:

1. A toy gun comprising:

a trigger;

a cartridge in which cartridge bullet loading portions capable of being loaded with bullets are continuously provided and which is installed ahead of the trigger;

a link mechanism which is extended from behind the trigger to the side opposite the cartridge installation position and thereafter inverted and whose tip is extended to ahead of the trigger; and a nail which is actuated through the link mechanism in conjunction with the actuation of the trigger and moves the cartridge.

2. The toy gun according to claim 1, further comprising:

a gas discharging means which moves toward the cartridge in conjunction with the actuation of the trigger and discharges gas to a cartridge bullet loading portion; and a cylindrical cover provided between the gas discharging means and each cartridge bullet loading portion.

3. A toy gun comprising:

a trigger;

a cartridge in which cartridge bullet loading portions capable of being loaded with bullets are continuously provided, the cartridge is ahead of the trigger or behind the trigger;

a link mechanism that extends from the trigger to a side opposite an installation position of the cartridge and thereafter inverted and whose tip is extended to the cartridge; and a nail which is actuated through the link mechanism in conjunction with an actuation of the trigger and moves the cartridge, wherein the distance between a fulcrum and a point of load of each main component of the link mechanism is longer than the distance between a point of effort and the fulcrum.

4. A toy gun according to claim 3, wherein the link mechanism extends from behind the trigger to the side opposite the installation position of the cartridge and thereafter inverted and whose tip is extended to ahead of the trigger.

5. A toy gun according to claim 3, further comprising:

a gas discharging means which moves toward the cartridge in conjunction with the actuation of the trigger and discharges gas to a cartridge bullet loading portion; and a cylindrical cover provided between the gas discharging means and each cartridge bullet loading portion.

6. The toy gun according to claim 3, wherein main components of the link mechanism comprise two links and an arm.

7. The toy gun according to claim 4, further comprising:

a gas discharging means which moves toward the cartridge in conjunction with the actuation of the trigger and discharges gas to a cartridge bullet loading portion; and a cylindrical cover provided between the gas discharging means and each cartridge bullet loading portion.

8. The toy gun according to claim 4, wherein main components of the link mechanism comprise two links and an arm.

* * * * *